US011727849B2

(12) United States Patent
Lu et al.

(10) Patent No.: US 11,727,849 B2
(45) Date of Patent: Aug. 15, 2023

(54) DISPLAY PANEL AND DISPLAY APPARATUS

(71) Applicant: KunShan Go-Visionox Opto-Electronics Co., Ltd, Jiangsu (CN)

(72) Inventors: Huiling Lu, Kunshan (CN); Lu Zhang, Kunshan (CN); Jie Zhu, Kunshan (CN); Siming Hu, Kunshan (CN)

(73) Assignee: KunShan Go-Visionox Opto-Electronics Co., Ltd, Kunshan (CN)

( * ) Notice: Subject to any disclaimer, the term of this patent is extended or adjusted under 35 U.S.C. 154(b) by 0 days.

(21) Appl. No.: 17/988,408

(22) Filed: Nov. 16, 2022

(65) Prior Publication Data

US 2023/0079966 A1 Mar. 16, 2023

Related U.S. Application Data

(63) Continuation of application No. PCT/CN2021/099870, filed on Jun. 11, 2021.

(30) Foreign Application Priority Data

Aug. 25, 2020 (CN) ..... 202010862493.5

(51) Int. Cl.
*G09G 3/3208* (2016.01)
*G09G 3/20* (2006.01)

(52) U.S. Cl.
CPC ..... *G09G 3/2074* (2013.01); *G09G 3/3208* (2013.01); *G09G 2300/0452* (2013.01);
(Continued)

(58) Field of Classification Search
CPC ..... G09G 2300/0426; G09G 3/3233; G09G 2300/0452; G09G 2320/0233;
(Continued)

(56) References Cited

U.S. PATENT DOCUMENTS

2013/0234954 A1 9/2013 Koide
2018/0240389 A1* 8/2018 Li ..... G09G 3/2003
(Continued)

FOREIGN PATENT DOCUMENTS

CN 103257743 A 8/2013
CN 104409044 A 3/2015
(Continued)

OTHER PUBLICATIONS

International Search Report, with accompanying translation, dated Sep. 10, 2021, in corresponding International Patent Application No. PCT/CN2021/099870; 6 pages.
(Continued)

*Primary Examiner* — Michael A Faragalla
(74) *Attorney, Agent, or Firm* — Maier & Maier, PLLC

(57) ABSTRACT

A display panel and a display apparatus. The display panel includes a display area and a non-display area surrounding the display area, the display area includes a first display area and a second display area, and a light transmittance of the first display area is greater than a light transmittance of the second display area; the display panel includes: a plurality of first pixel units, located in the first display area, the first pixel unit includes a plurality of first sub-pixels with at least three colors; a plurality of demultiplexers, located in the non-display area, the demultiplexer includes at least two signal output terminals with different charging modes, and the first sub-pixels with a same color in the first pixel units are electrically connected to the signal output terminals with a same charging mode in the demultiplexers.

13 Claims, 8 Drawing Sheets

(52) U.S. Cl.
CPC ..... *G09G 2300/0465* (2013.01); *G09G 2300/0842* (2013.01); *G09G 2310/0264* (2013.01); *G09G 2310/0297* (2013.01); *G09G 2320/0233* (2013.01)

(58) Field of Classification Search
CPC .... G09G 3/3225; H10K 59/65; H10K 59/121; H10K 59/131
See application file for complete search history.

(56) References Cited

U.S. PATENT DOCUMENTS

| | | | | |
|---|---|---|---|---|
| 2019/0347976 | A1 | 11/2019 | Um et al. | |
| 2020/0027405 | A1* | 1/2020 | Lee ..... | G09G 3/3225 |

FOREIGN PATENT DOCUMENTS

| | | | |
|---|---|---|---|
| CN | 104752468 | A | 7/2015 |
| CN | 104914606 | A | 9/2015 |
| CN | 104992681 | A | 10/2015 |
| CN | 105469752 | A | 4/2016 |
| CN | 105761675 | A | 7/2016 |
| CN | 107863062 | A | 3/2018 |
| CN | 107885397 | A | 4/2018 |
| CN | 108766338 | A | 11/2018 |
| CN | 109449196 | A | 3/2019 |
| CN | 109637414 | A | 4/2019 |
| CN | 110335561 | A | 10/2019 |
| CN | 110738966 | A | 1/2020 |
| CN | 110880286 | A | 3/2020 |
| CN | 110955091 | A | 4/2020 |
| CN | 111161667 | A | 5/2020 |
| CN | 111180483 | | 5/2020 |
| CN | 111462695 | A | 7/2020 |
| CN | 111951727 | | 11/2020 |
| KR | 20070033562 | A | 3/2007 |
| KR | 20170030735 | A | 3/2017 |
| TW | 202001842 | A | 1/2020 |

OTHER PUBLICATIONS

Chinese Office Action, with accompanying translation, dated Apr. 20, 2021, in corresponding Chinese Patent Application No. 202010862493.5; 13 pages.

Chinese Office Action, with accompanying translation, dated Nov. 8, 2021, in corresponding Chinese Patent Application No. 202010862493.5; 18 pages.

Rejection Decision, with accompanying translation, dated Apr. 8, 2022, in corresponding Chinese Patent Application No. 202010862493.5; 6 pages.

Reexamination Decision, with accompanying translation, dated Sep. 1, 2022, in corresponding Chinese Patent Application No. 202010862493.5; 2 pages.

Notification to Grant Patent Right for Invention, with accompanying translation, dated Sep. 23, 2022, in corresponding Chinese Patent Application No. 202010862493.5; 7 pages.

Taiwanese Office Action, with accompanying translation, dated Apr. 27, 2022, in corresponding Taiwanese Patent Application No. 110124194, 10 pages.

Fan Zhang et al., Driving Module for 12.7cm Full-color AM-OLED Display, with accompanying English Abstract, Liquid Crystal and Display, Issue 05, dated Oct. 26, 2006; 5 pages.

* cited by examiner

DISPLAY PANEL AND DISPLAY APPARATUS

CROSS REFERENCE TO RELATED APPLICATION

The present application is a continuation of International Application No. PCT/CN2021/099870 filed on Jun. 11, 2021, which claims the benefit of priority to Chinese Patent Application No. 202010862493.5 filed on Aug. 25, 2020, both of which are incorporated herein by reference in their entireties.

TECHNICAL FIELD

The present application relates to the field of display technology, and particularly to a display panel and a display apparatus.

BACKGROUND

With the rapid development of electronic devices, demands of users for the screen-to-body ratio are higher and higher, resulting in that the full-screen display of electronic devices attracts more and more attention in the industry.

At present, the design with an under-screen camera has been developed, in which the under-screen camera means that the camera is located under the display screen and does not affect the display of the display screen. When the camera is not used by the user, the display screen above the camera normally displays the image, and when the camera is used by the user, the display screen above the camera does not display the image.

In order to ensure the light transmittance of the area corresponding to the camera in the display screen, the pixel density of this area is generally less than that of other areas of the display screen. Therefore, display unevenness (mura) in this area is usually obvious, which affects the user experience.

SUMMARY

A first aspect of the present application provides a display panel comprising a display area and a non-display area surrounding the display area, the display area comprising a first display area and a second display area, and a light transmittance of the first display area being greater than a light transmittance of the second display area; the display panel comprising: a plurality of first pixel units, located in the first display area, the first pixel unit comprising a plurality of first sub-pixels with at least three colors; a plurality of demultiplexers, located in the non-display area, the demultiplexer comprising at least two signal output terminals with different charging modes, wherein the first sub-pixels with a same color in the first pixel units are electrically connected to the signal output terminals with a same charging mode in the demultiplexers.

A second aspect of the present application provides a display apparatus comprising the display panel of any one of the embodiments of the first aspect.

According to the display panel and display apparatus provided by the embodiments of the present application, in the display panel, the light transmittance of the first display area is greater than the light transmittance of the second display area; the plurality of first pixel units are located in the first display area and the first pixel unit includes a plurality of first sub-pixels with at least three colors; the plurality of demultiplexers are located in the non-display area of the display panel and the demultiplexer includes at least two signal output terminals with different charging modes; and in the first display area, the first sub-pixels with a same color in the first pixel units are electrically connected to the signal output terminals with a same charging mode in the demultiplexers. The signal output terminals electrically connected to the first sub-pixels with a same color have a same charging mode, which can ensure that the first sub-pixels with the same color are charged with a same charging efficiency and avoid brightness difference for the first sub-pixels with the same color caused by different charging efficiencies, so that display unevenness (mura) in the first display area can be avoided and the display quality of the first display area is thereby improved.

BRIEF DESCRIPTION OF THE DRAWINGS

Other features, objects, and advantages of the present application will become more apparent by reading the following detailed description of non-limiting embodiments with reference to the accompanying drawings, in which the same or similar reference numerals represent the same or similar features. The accompanying drawings are not drawn to actual scale.

DETAILED DESCRIPTION

Features and exemplary embodiments of various aspects of the present application will be described in detail below. To make the objects, technical solutions and advantages of the present application clearer, the present application will be further described in detail below with reference to the accompanying drawings and specific embodiments. It is understood that the specific embodiments described herein are merely configured to explain the present application, rather than to limit the present application. For those skilled in the art, the present application can be implemented without some of these specific details. The following description of the embodiments is merely to provide a better understanding of the present application by illustrating the examples of the present application.

In order to achieve the full-screen display, a light-transmitting display area may be provided on the display panel. Generally, the pixel density (Pixels Per Inch, PPI) of the light-transmitting display area is less than that of other areas of the display panel. Moreover, in the prior art, it is not considered either the charging modes of different signal output terminals of the demultiplexer (Demux) are different or the charging efficiencies corresponding to the different charging modes are also different. In the prior art, the sub-pixels with various colors in the light-transmitting display area are generally arbitrarily connected to the signal output terminals of the demultiplexer, causing that the sub-pixels with a same color in the light-transmitting display area are corresponding to the signal output terminals with different charging modes and that the charging efficiencies of the sub-pixels with the same color are inconsistent, therefore the brightness of the sub-pixels with the same color is inconsistent. Nonetheless, the pixel density of the light-transmitting display area is relatively less and the brightness of the sub-pixels with the same color is inconsistent, mura visible to human eyes usually occurs.

To solve the above problems, the embodiments of the present application provide a display panel and a display apparatus, which will be described below with reference to the drawings.

The embodiments of the present application provide a display panel, which may be an organic light emitting diode (Organic Light Emitting Diode, OLED) display panel.

Figure 1:
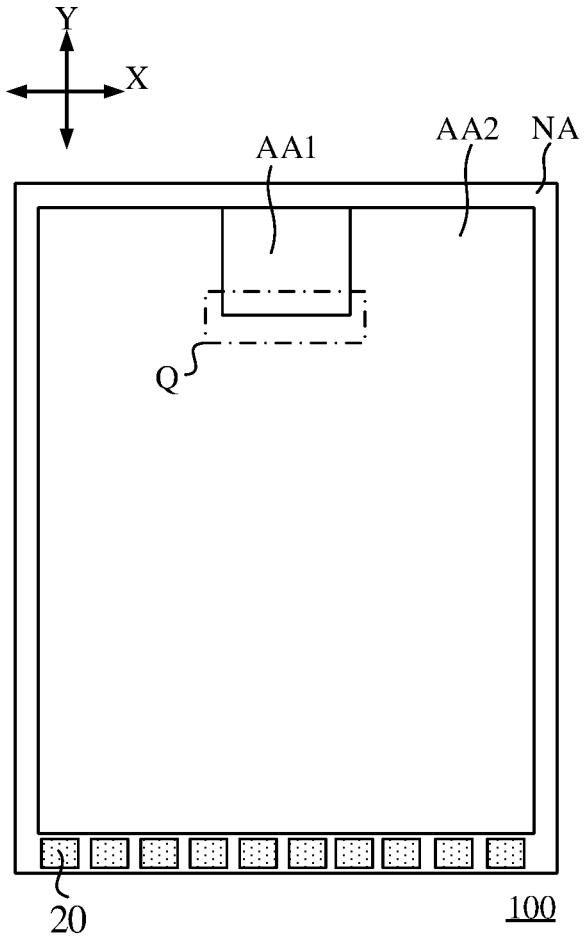
FIG. 1 shows a top view of a display panel according to an embodiment of the present application.
Figure 2:
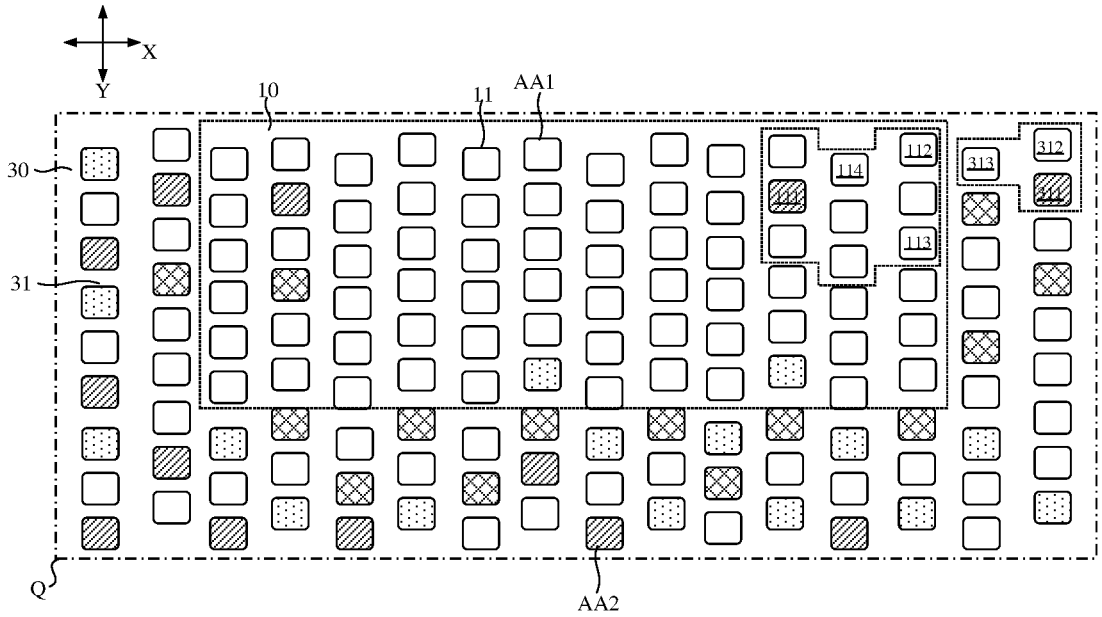
FIG. 2 shows a partial enlarged diagram of the area Q in FIG. 1 in an example.

FIG. 1 shows a top view of a display panel according to an embodiment of the present application, and FIG. 2 shows a partial enlarged diagram of the area Q in FIG. 1 in an example.

As shown in FIG. 1, the display panel 100 includes a display area and a non-display area NA surrounding the display area. The display area includes a first display area AA1 and a second display area AA2. The light transmittance of the first display area AA1 is greater than the light transmittance of the second display area AA2.

In the present application, the light transmittance of the first display area AA1 may be greater than or equal to 15%. In order to ensure that the light transmittance of the first display area AA1 is greater than 15%, or even greater than 40%, or even a higher light transmittance, the light transmittance of at least part of functional films of the display panel 100 in the embodiment may be greater than 80%, and even the light transmittance of at least part of the functional films may be greater than 90%.

According to the display panel 100 of the embodiments of the present application, the light transmittance of the first display area AA1 is greater than the light transmittance of the second display area AA2, so that the photosensitive assembly may be integrated on the rear of the first display area AA1 of the display panel 100. An under-screen integration is achieved for the photosensitive assembly such as a camera, and moreover, the first display area AA1 can display the image, the display area of the display panel 100 is increased and a full-screen design is achieved for the display apparatus.

The shape of the first display area AA1 may be a circle, an ellipse, a rectangle or other polygons. The first display area AA1 may be disposed close to the edge or the center of the display panel 100. The specific shape and position of the first display area AA1 may be set according to actual requirements, which are not limited in the present application.

Figure 3:
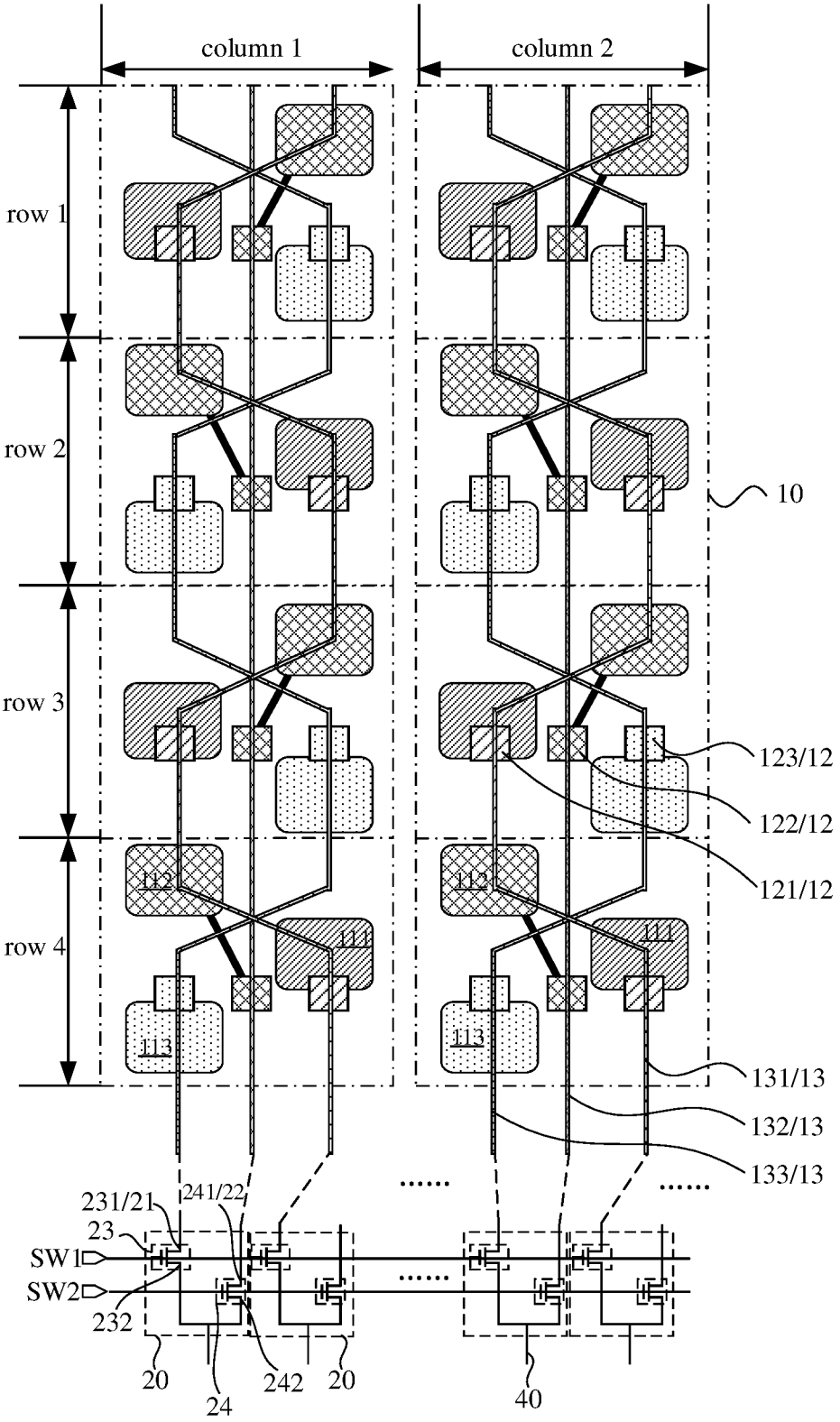
FIG. 3 shows a schematic diagram of the connections between the first sub-pixels and the demultiplexers according to an embodiment of the present application.

FIG. 3 shows a schematic diagram of the connections between the first sub-pixels and the demultiplexers according to an embodiment of the present application. Referring to FIG. 1 to FIG. 3 together, the display panel 100 of the embodiments of the present application may include a plurality of first pixel units 10 and a plurality of demultiplexers 20. The plurality of first pixel units 10 are located in the first display area AA1 and the first pixel unit 10 includes a plurality of first sub-pixels 11 with at least three colors. The accompanying drawings of the present application illustrate that each of the first pixel units 10 includes a plurality of first sub-pixels 11 with three colors. The plurality of demultiplexers 20 are located in the non-display area NA of the display panel 100 and the demultiplexer includes at least two signal output terminals with different charging modes. The accompanying drawings of the present application illustrate that the each of the demultiplexers 20 includes two signal output terminals with different charging modes, that is, the first signal output terminal 21 and the second signal output terminal 22.

The first sub-pixels 11 with a same color in the first pixel units 10 are electrically connected to the signal output terminals with a same charging mode in the demultiplexers 20. Exemplarily, as shown in FIG. 3, each of the first pixel units 10 includes the first sub-pixels 11 with three colors, that is, the first sub-pixel 111 with a first color, the first sub-pixel 112 with a second color and the first sub-pixel 113 with a third color. The three first sub-pixels 11 with the three colors in the first pixel unit 10 may be distributed as a Chinese character "A". In the accompanying drawings of the present application, the same filling represents sub-pixels with a same color.

FIG. 3 shows a total of 8 first pixel units 10 disposed in 4 rows and 2 columns, the first sub-pixel 111 with the first color in each of the first pixel units 10 is electrically connected to the first signal output terminal 21 of the demultiplexer 20, the first sub-pixel 112 with the second color in each of the first pixel units 10 is electrically connected to the second signal output terminal 22 of the demultiplexer 20, and the first sub-pixel 113 with the third color in each of the first pixel units 10 is electrically connected to the first signal output terminal 21 of the demultiplexer 20.

Exemplarily, a ratio between the signal input terminals and the signal output terminals of the demultiplexer 20 may be 1:N, and N is a positive integer greater than or equal to 2. That is, the demultiplexer 20 includes one signal input terminal and N signal output terminals. For example, the demultiplexer 20 includes three signal output terminals, and at least two of the three signal output terminals may have different charging modes.

Exemplarily, the time division multiplexing may be utilized to receive different signals from a signal input terminal and send out the different signals through different signal output terminals.

Figure 4:
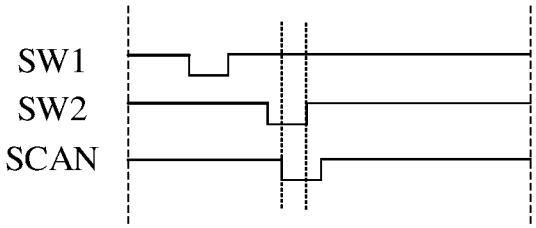
FIG. 4 shows a schematic timing diagram of a display panel according to an embodiment of the present application.

For example, as shown in FIG. 3, the demultiplexer 20 includes a first signal output terminal 21 and a second signal output terminal 22. FIG. 4 shows a schematic timing diagram of a display panel according to an embodiment of the present application. Exemplarily, the first signal output terminal 21 is controlled by a first control signal output by a first control signal terminal SW1 and is configured to output a signal when the first control signal is a low-level signal. The second signal output terminal 22 is controlled by a second control signal output by a second control signal terminal SW2 and is configured to output a signal when the second control signal is a low-level signal.

Exemplarily, within the scanning duration of a row, firstly the first control signal is at a low level, and then the second control signal is at a low level, the low level of the first control signal does not overlap with the low level of the second control signal due to the time division multiplexing. The display panel of the embodiments of the present application further includes scan lines (not shown) electrically connected to the first pixel units 10 in each row, and transmits a scan signal (SCAN) to the first pixel units 10 in each row through the scan lines. Since the scanning duration of each row is relatively short, the low level of the scan signal (SCAN) may overlap with the low level of the second control signal. Only when the scan signal (SCAN) is at the low level, the signals output by the first signal output terminal 21 and the second signal output terminal 22 can be written to the corresponding first sub-pixels. Therefore, since the low level of the first control signal does not overlap with the low level of the scan signal, the signal output by the first signal output terminal 21 may be firstly stored on a signal line and then input to a corresponding first sub-pixel, and the charging mode of the first signal output terminal 21 may be called wire charging. The low level of the second control signal overlaps with the low level of the scan signal, the signal output by the second signal output terminal 22 may be directly input to a corresponding first sub-pixel, and the charging mode of the second signal output terminal 22 may be called direct charging. The charging efficiencies of the two charging modes are different.

According to the embodiments of the present application, the signal output terminals electrically connected to the first sub-pixels with a same color have a same charging mode, which can ensure that the first sub-pixels with the same color are charged with a same charging efficiency and avoid brightness difference for the first sub-pixels with the same color caused by different charging efficiencies, so that display unevenness (mura) in the first display area can be avoided and the display quality of the first display area is thereby improved.

In some embodiments, still referring to FIG. 3, the display panel of the embodiments of the present application further includes a plurality of first pixel circuits 12 and a plurality of first data lines 13. Each of the first sub-pixels 11 is electrically connected to one of the first pixel circuits 12. In the accompanying drawings of the present application, the filling of the first sub-pixels 11 with respective colors is the same as that of the corresponding first pixel circuit. Exemplarily, the first sub-pixel 111 with the first color is correspondingly electrically connected to the first pixel circuit 121, the first sub-pixel 112 with the second color is correspondingly electrically connected to the first pixel circuit 122, and the first sub-pixel 113 with the third color is correspondingly electrically connected to the first pixel circuit 123. In the first pixel units 10 in a same column, the first pixel circuits 122 corresponding to the first sub-pixels 112 with the second color may belong to a same column, the first pixel circuits 121 corresponding to the first sub-pixels 111 with the first color may be disposed adjacent to the first sub-pixels 111 with the first color, and the first pixel circuits 123 corresponding to the first sub-pixels 113 with the third color may be disposed adjacent to the first sub-pixels 113 with the third color.

In some embodiments, the circuit structure of the first pixel circuit 12 may be any one of a 2T1C circuit, a 3T1C circuit, a 6T1C circuit, a 6T2C circuit, a 7T1C circuit, a 7T2C circuit or a 9T1C circuit. In the present application, the "2T1C circuit" refers to a pixel circuit including two thin film transistors (T) and one capacitor (C), and the same is true for other "7T1C circuit", "7T2C circuit", "9T1C circuit" and so on.

In some embodiments, the plurality of first data lines 13 extend in the first display area AA1 along a column direction Y and are distributed at intervals along a row direction X, where the "row" and "column" are interchangeable. Each of the first data lines 13 is electrically connected to at least one first pixel circuit 12 and at least one signal output terminal of the demultiplexer 20, and the first sub-pixels 11 electrically connected to a same first data line 13 are the first sub-pixels with a same color. That is, one first data line 13 is only electrically connected to the first sub-pixels 11 with one color, so that it is convenient to achieve that the signal output terminals electrically connected to the first sub-pixels with a same color have a same charging mode.

Here, the first data line 13 extends along the column direction Y means that the first data line 13 extends along the column direction Y as a whole. As shown in FIG. 3, exemplarily, each of the first data lines 13 includes a first sub-data line 131, a second sub-data line 132 and a third sub-data line 133. The first sub-data line 131 is electrically connected to the first sub-pixel 111 with the first color, the second sub-data line 132 is electrically connected to the first sub-pixel 112 with the second color, and the third sub-data line 133 is electrically connected to the first sub-pixel 113 with the third color. The first pixel units 10 in a same column are corresponding to the first pixel circuits 12 in three columns, the first pixel circuits 12 in three columns may include a first column of first pixel circuits, a second column of first pixel circuits and a third column of first pixel circuits, the first pixel circuits 122 corresponding to the first sub-pixels 112 with the second color may belong to the first column of first pixel circuits, and each of the second column of first pixel circuits 12 and the third column of first pixel circuits 12 includes the first pixel circuit 121 corresponding to the first sub-pixel 111 with the first color and the first pixel circuit 123 corresponding to the first sub-pixel 113 with the third color. In order to ensure that each of the first data lines 13 is only electrically connected to the first sub-pixels 11 with one color, the first sub-data line 131 and the third sub-data line 133 may be interleaved with each other, and the first sub-data line 131 and the third sub-data line 133 extend along the column direction Y as a whole.

Figure 5:
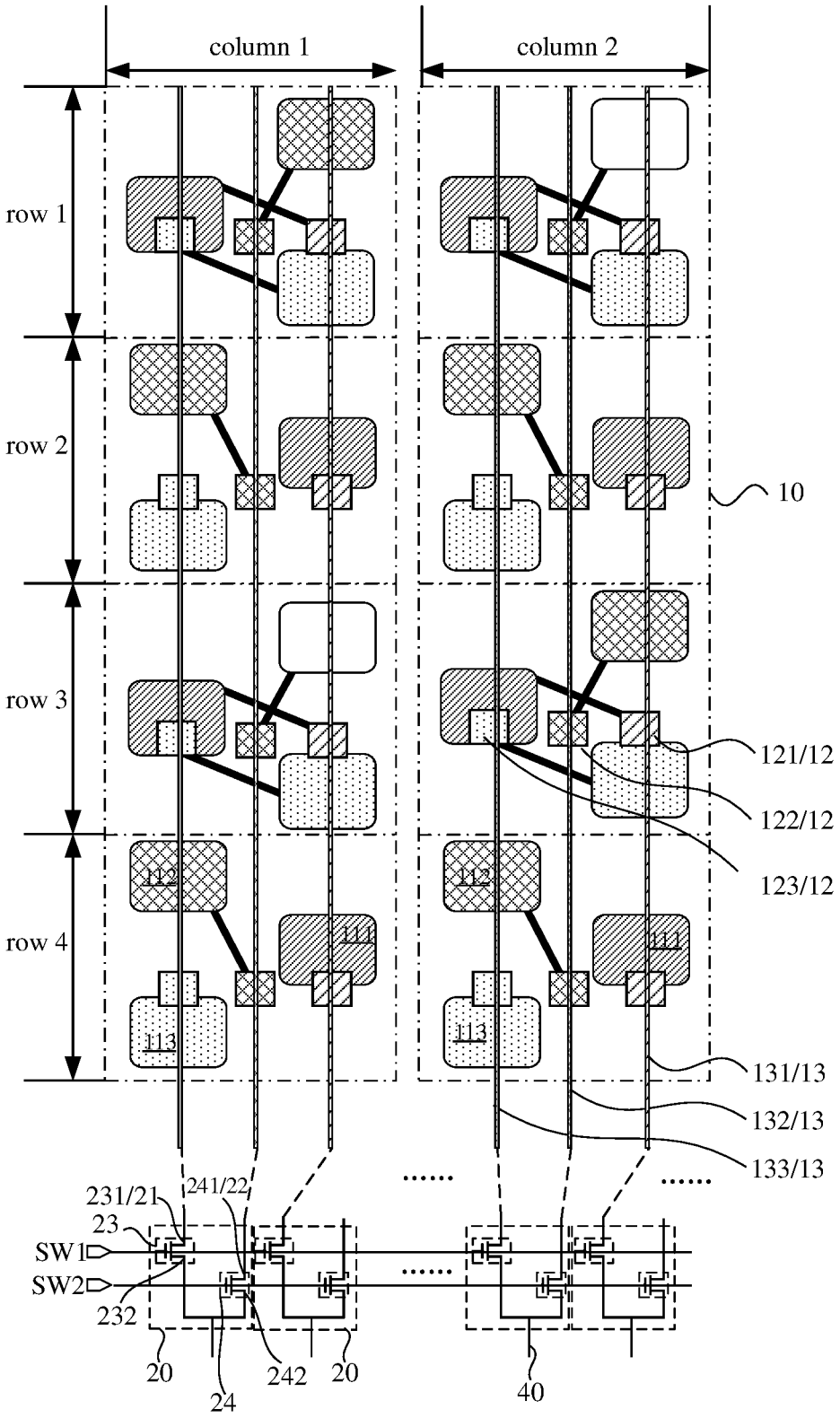
FIG. 5 shows a schematic diagram of the connections between the first sub-pixels and the demultiplexers according to another embodiment of the present application, in which compared with FIG. 3, the first pixel circuits corresponding to the first sub-pixels with a same color in a same column of the first pixel units are located in a same column.

FIG. 5 shows a schematic diagram of the connections between the first sub-pixels and the demultiplexers according to another embodiment of the present application. In some optional embodiments, as shown in FIG. 2 and FIG. 5, the plurality of first pixel units 10 may be distributed in an array in the first display area AA1, and the first pixel circuits 12 corresponding to the first sub-pixels 11 with a same color in a same column of the first pixel units 10 are located in a same column. Exemplarily, in the first pixel units 10 in a same column, the first pixel circuits 121 corresponding to the first sub-pixels 111 with the first color are located in a same column, the first pixel circuits 122 corresponding to the first sub-pixel 112*s* with the second color are located in a same column, and the first pixel circuits 123 corresponding to the first sub-pixels 113 with the third color are located in a same column. As such, the first data lines 13 corresponding to the first sub-pixels 11 with respective colors may extend linearly along the column direction Y, that is, the first data lines 13 corresponding to the first sub-pixels 11 with respective colors may not be interleaved, which can prevent the signals on each of the first data lines 13 from interfering with each other.

Figure 6:
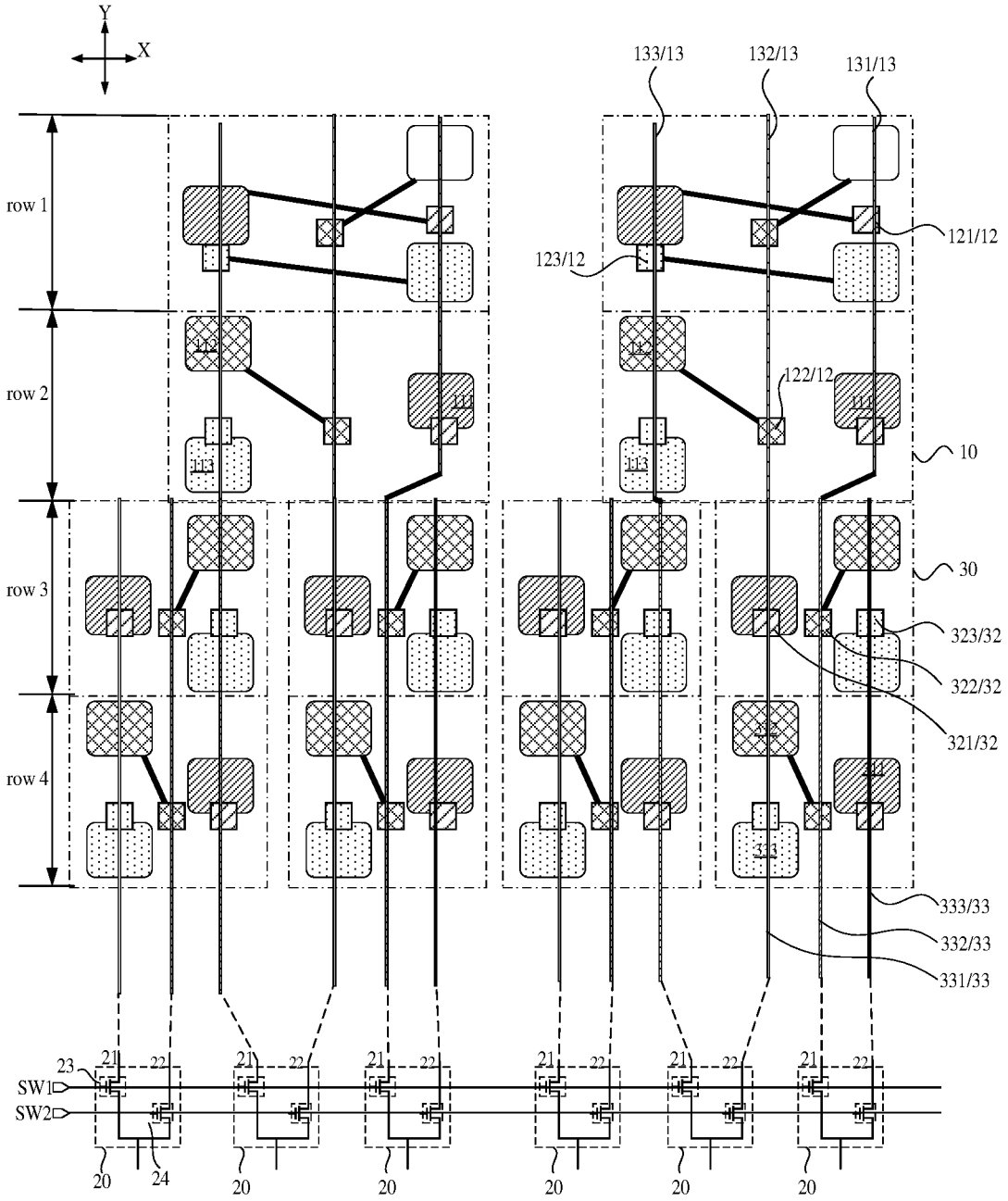
FIG. 6 shows a schematic diagram of the relationship of the first sub-pixels and the second sub-pixels with the output terminals of the demultiplexers according to an embodiment of the present application.

FIG. 6 shows a schematic diagram of the relationship of the first sub-pixels and the second sub-pixels with the output terminals of the demultiplexers according to an embodiment of the present application. In some optional embodiments, as shown in FIG. 2 and FIG. 6, the display panel may further include a plurality of second pixel units 30, a plurality of second pixel circuits 32 and a plurality of second data lines 33. The plurality of second pixel units 30 are located in the second display area AA2 and each may include a plurality of second sub-pixels 31 with at least three colors. Exemplarily, the sizes of the first sub-pixel 11 and the second sub-pixel 31 with a same color may be the same, and the distance between the two adjacent first sub-pixels 11 with the same color may be greater than the distance between the two adjacent second sub-pixels 31 with the same color to increase the light transmittance of the first display area AA1. FIG. 2 shows that the first pixel unit 10 includes a dummy sub-pixel 114 which only represents that it occupies a position of a sub-pixel, but no sub-pixel structure is disposed at this position. The first sub-pixels and the second sub-pixels may be formed simultaneously with a same mask to simplify the processing.

Each of the second sub-pixels 31 is electrically connected to one of the second pixel circuits 32. Exemplarily, each of the second pixel units 30 may include a plurality of second sub-pixels with three colors, that is, a second sub-pixel 311 with a first color, a second sub-pixel 312 with a second color and a second sub-pixel 313 with a third color. The second sub-pixel 311 with the first color is correspondingly electrically connected to the second pixel circuit 321, the second sub-pixel 312 with the second color is correspondingly electrically connected to the second pixel circuit 322, and the second sub-pixel 313 with the third color is correspondingly electrically connected to the second pixel circuit 323.

Exemplarily, the circuit structure of the second pixel circuit 32 may be the same as that of the first pixel circuit 12. Alternatively, the number of transistors and/or capacitors in the second pixel circuit 32 may be greater than the number of transistors and/or capacitors in the first pixel circuit 12.

The plurality of second data lines 33 extend in the second display area AA2 along the column direction Y and are distributed at intervals along the row direction X. Each of the second data lines 33 is electrically connected to at least one second pixel circuit 32 and at least one signal output terminal of the demultiplexer 20. Since the pixel density of the second display area AA2 is relatively great, even if the second sub-pixels with a same color are electrically connected to the signal output terminals with different charging modes, no obvious mura will occur in the second display area AA2, therefore the charging mode of the signal output terminals to which the second sub-pixels with respective colors are electrically connected may be not limited. Since the plurality of demultiplexers 20 are generally distributed along the row direction X, each of the second data lines 33 may be electrically connected to the signal output terminals of the demultiplexer 20 that is close to it, so as to shorten the connecting lines for connecting the second data lines 33 with the signal output terminals of the demultiplexers 20 to further reduce the frame.

In some optional embodiments, still referring to FIG. 2 and FIG. 6, the plurality of second pixel units 30 may be distributed in an array in the second display area AA2, and each of the second pixel units 30 includes the second sub-pixel 311 with the first color, the second sub-pixel 312 with the second color and the second sub-pixel 313 with the third color.

Exemplarily, in the second pixel units 30 in a same column, the second pixel circuits 322 corresponding to the second sub-pixels 312 with the second color may belong to a same column, the second pixel circuits 321 corresponding to the second sub-pixels 311 with the first color may be disposed adjacent to the second sub-pixels 311 with the first color, and the second pixel circuits 323 corresponding to the second sub-pixels 313 with the third color may be disposed adjacent to the second sub-pixels 313 with the third color. That is, the second pixel units 30 in a same column are corresponding to the second pixel circuits 32 in three columns, the second pixel circuits 32 in three columns may include a first column of second pixel circuits, a second column of second pixel circuits and a third column of second pixel circuits, the second pixel circuits 322 corresponding to the second sub-pixels 312 with the second color may belong to the first column of second pixel circuits, and each of the second column of second pixel circuits and the third column of second pixel circuits includes the second pixel circuit 321 corresponding to the second sub-pixel 311 with the first color and the second pixel circuit 323 corresponding to the second sub-pixel 313 with the third color. That is, the second pixel units 30 in a same column are corresponding to the second pixel circuits in three columns, the second pixel circuits in three columns comprise a first column of second pixel circuits, a second column of second pixel circuits and a third column of second pixel circuits. Herein, the first column of second pixel circuits and the third column of second pixel circuits are electrically connected to the second sub-pixel with the first color and the second sub-pixel with the third color, the second sub-pixels electrically connected to any two adjacent second pixel circuits in the first column of second pixel circuits have different colors, the second sub-pixels electrically connected to any two adjacent second pixel circuits in the third column of second pixel circuits have different colors, the second sub-pixels electrically connected to two second pixel circuits in a same row and respectively in the first column of second pixel circuits and the third column of second pixel circuits have different colors, and the second column of second pixel circuits are electrically connected to the second sub-pixels with the second color.

Each of the second data lines 33 may extend linearly along the column direction Y and is electrically connected to the second pixel circuits 32 which belong to a same column. Exemplarily, each of the second data lines 33 may include a fourth sub-data line 331, a fifth sub-data line 332 and a sixth sub-data line 333. The fourth sub-data line 331 is electrically connected to the first column of second pixel circuits, the fifth sub-data line 332 is electrically connected to the second column of second pixel circuits, and the sixth sub-data line 333 is electrically connected to the third column of second pixel circuits. As such, the three second data lines 33 corresponding to each column of the second pixel units 30 are not interleaved, which can prevent the signals on the data lines from interfering with each other. Moreover, as described above, since the pixel density of the second display area AA2 is relatively great, even if the second sub-pixels with a same color are electrically connected to the signal output terminals with different charging modes, no obvious mura will occur in the second display area AA2, therefore the fourth sub-data line 331 and the sixth sub-data line 333 may be electrically connected to the second sub-pixels with different colors.

In some optional embodiments, still referring to FIG. 2 and FIG. 6, each of the first pixel units 10 includes the first sub-pixel 111 with the first color, the first sub-pixel 112 with the second color and the first sub-pixel 113 with the third color. Each of the first data lines 13 includes the first sub-data line 131, the second sub-data line 132 and the third sub-data line 133. In the first pixel units 10 in a same column, the first pixel circuits 12 corresponding to the first sub-pixels 11 with a same color may belong to a same column. The first sub-data line 131 is electrically connected to the first sub-pixel 111 with the first color, the second sub-data line 132 is electrically connected to the first sub-pixel 112 with the second color, and the third sub-data line 133 is electrically connected to the first sub-pixel 113 with the third color. Each of the first sub-data line 131, the second sub-data line 132 and the third sub-data line 133 is electrically connected to a corresponding signal output terminal of the demultiplexer through any one of the fourth sub-data line 331, the fifth sub-data line 332 and the sixth sub-data line 333 in a matching mode. Exemplarily, the first sub-data line 131 may be electrically connected to the first signal output terminal 21 through the fifth sub-data line 332 in the matching mode, the second sub-data line 132 may be electrically connected to the second signal output terminal 22 through the fourth sub-data line 331 in the matching mode, and the third sub-data line 133 may be electrically connected to the first signal output terminal 21 through the sixth sub-data line 333 in the matching mode. The matching mode here means that the charging modes of the signal output terminals corresponding to the sub-data lines in the second data line connected to the first sub-data line 131 are the same, and similarly, the charging modes of the signal output terminals corresponding to the sub-data lines in the second data line connected to the second sub-data line 132 are the same, and the charging modes of the signal output terminals corresponding to the sub-data lines in the second data line connected to the third sub-data line 133 are the same.

The first display area AA1 and the demultiplexers 20 are generally located at two sides of the display panel along the column direction and are away from each other, if the first data line 13 is directly connected to the demultiplexer 20, the first data line 13 further needs to pass through the second display area AA2, resulting in too many signal lines in the second display area AA2, which can avoid too many signal lines in the display panel.

In some optional embodiments, each of the demultiplexers 20 may include the first signal output terminal 21 and the second signal output terminal 22 with different charging modes, the first sub-data line 131 and the third sub-data line 133 are electrically connected to the first signal output terminal 21, and the second sub-data line 132 is electrically connected to the second signal output terminal 22. This is just an example, and under a condition that the charging modes of the signal output terminals to which the first sub-pixels with a same color are electrically connected are guaranteed to be the same, the connection relations between respective sub-data lines and respective signal output terminals may be set according to actual requirements, which is not limited in the present application.

In some optional embodiments, referring to FIG. 3 or FIG. 5, each of the demultiplexers 20 may include a first transistor 23 and a second transistor 24. A gate of the first transistor 23 is electrically connected to the first control signal terminal SW1, and a gate of the second transistor 24 is electrically connected to the second control signal terminal SW2. A first electrode 231 of the first transistor 23 is the first signal output terminal 21, a first electrode of 241 the second transistor 24 is the second signal output terminal 22, and a second electrode 232 of the first transistor 23 and a second electrode 242 of the second transistor 24 are electrically connected to a fan-out line 40. The above structure is only an example circuit structure of the demultiplexer 20, and the circuit structure of the demultiplexer 20 is not limited hereto and may be set according to actual requirements.

Figure 7:
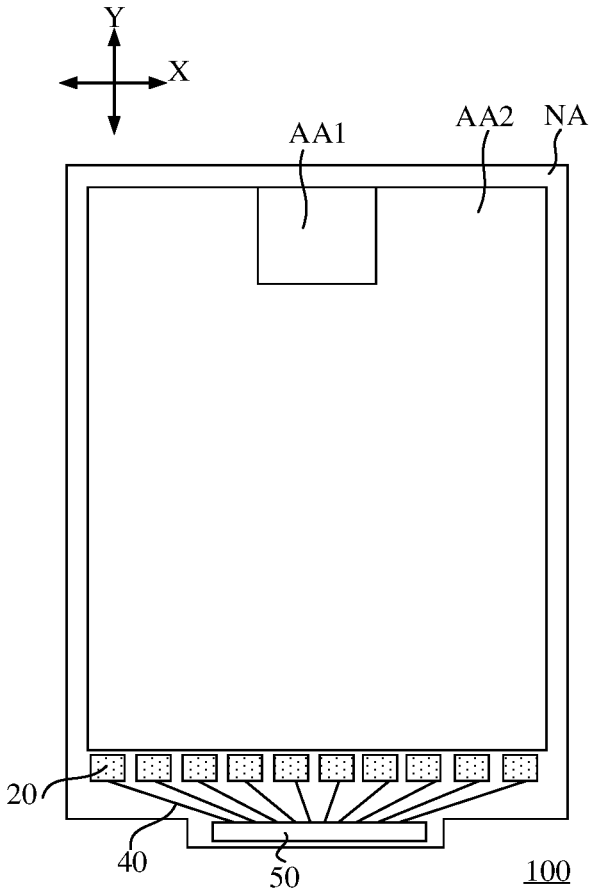
FIG. 7 shows a schematic structural diagram of a display panel according to another embodiment of the present application.

FIG. 7 shows a schematic structural diagram of a display panel according to another embodiment of the present application. As shown in FIG. 7, the display panel 100 further includes a binding area 50. The fan-out line 40 extends to the bonding area 50. In some embodiments, the display panel 100 further includes an integrated circuit (Integrated Circuit, IC) chip and a flexible printed circuit (Flexible Printed Circuit, FPC), and the IC chip may be disposed in the binding area 50 through the flexible circuit board. Each of the demultiplexers 20 is electrically connected to the IC chip through a fan-out line 40 to receive data signals sent by the IC chip.

In some optional embodiments, each of the first sub-pixel 111 with the first color and the second sub-pixel 311 with the first color is a red sub-pixel, each of the first sub-pixel 112 with the second color and the second sub-pixel 312 with the second color is a green sub-pixel, and each of the first sub-pixel 113 with the third color and the second sub-pixel 313 with the third color is a blue sub-pixel. The above description is just an example, the first color is not limited to red, the second color is not limited to green, and the third color is not limited to blue, the colors corresponding to respective sub-pixels may be set according to actual requirements.

The embodiments of the present application further provide a display apparatus which may include the display panel 100 of any one of the above embodiments. A display apparatus of an embodiment will be described below as an example, in which the display apparatus includes the display panel 100 of the above embodiments.

Figure 8:
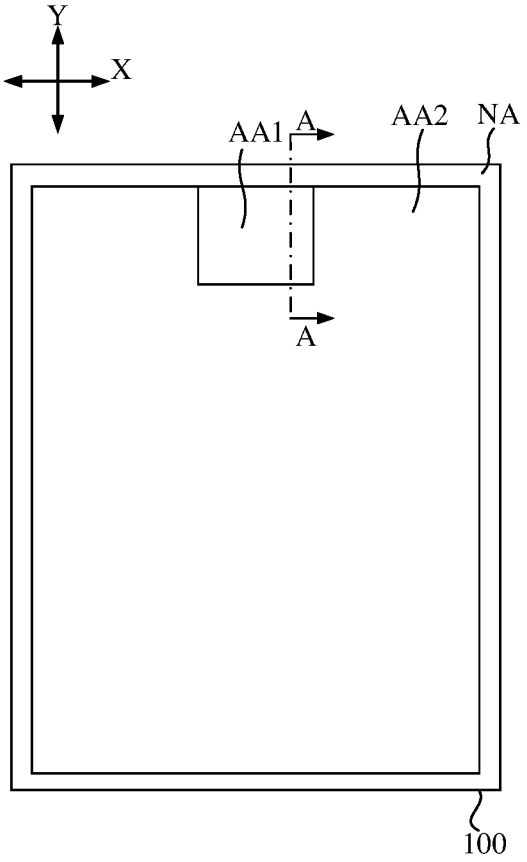
FIG. 8 shows a schematic structural diagram of a display apparatus according to an embodiment of the present application.
Figure 9:
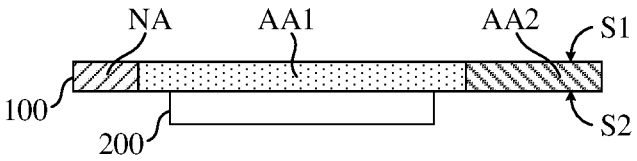
FIG. 9 shows a cross-sectional view taken along the line A-A in FIG. 8.

FIG. 8 shows a schematic structural diagram of a display apparatus according to an embodiment of the present application, and FIG. 9 shows a cross-sectional view taken along the line A-A in FIG. 8. In the display apparatus of the embodiment, the display panel 100 may be the display panel 100 of one of the above embodiments, in which the display panel 100 includes the first display area AA1, the second display area AA2, and the non-display area NA surrounding the first display area AA1 and the second display area AA2, and the light transmittance of the first display area AA1 is greater than the light transmittance of the second display area AA2.

The display panel 100 includes a first surface S1 and a second surface S2 opposite to each other, in which the first surface S1 is a display surface. The display apparatus further includes a photosensitive assembly 200 located on a side of the display panel 100 corresponding to the second surface S2, and the position of the photosensitive assembly 200 is corresponding to the position of the first display area AA1.

The photosensitive assembly 200 may be an image capturing device for capturing external image information. In the embodiment, the photosensitive assembly 200 is a complementary metal oxide semiconductor (Complementary Metal Oxide Semiconductor, CMOS) image capturing device, and in some other embodiments, the photosensitive assembly 200 may be another image capturing device such as a charge-coupled device (Charge-coupled Device, CCD) image capturing device. It may be appreciated that the photosensitive assembly 200 may not be limited to an image capturing device. For example, in some embodiments, the photosensitive assembly 200 may be a light sensor such as an infrared sensor, a proximity sensor, an infrared lens, a flood light sensing element, an ambient light sensor and a dot projector. In addition, other components such as a telephone receiver and a speaker may also be integrated on the second surface S2 of the display panel 100 of the display apparatus.

According to the display apparatus of the embodiments of the present application, the signal output terminals electrically connected to the first sub-pixels with a same color have a same charging mode, which can ensure that the first sub-pixels with the same color are charged with a same charging efficiency and avoid brightness difference for the first sub-pixels with the same color caused by different charging efficiencies, so that display unevenness (mura) in the first display area can be avoided and the display quality of the first display area is thereby improved.

The above embodiments of the present application do not exhaustively describe all the details, nor do they limit the scope of the present application. Obviously, according to the above description, those skilled in the art cam make many modifications and changes. These embodiments are specifically described in the specification to better explain the principles and practical applications of the present application, so that those skilled in the art can make good use of the present application and make modifications based on the present application. The scope of the present application is only defined by the appended claims.

What is claimed is:

1. A display panel comprising a display area and a non-display area surrounding the display area, the display area comprising a first display area and a second display area, and a light transmittance of the first display area being greater than a light transmittance of the second display area;

the display panel comprising:

a plurality of first pixel units, located in the first display area, the first pixel unit comprising a plurality of first sub-pixels with at least three colors;

a plurality of demultiplexers, located in the non-display area, the demultiplexer comprising at least two signal output terminals with different charging modes, a plurality of first pixel circuits;

a plurality of first data lines extending in the first display area along a column direction and being distributed at intervals along a row direction, each of the first data lines being electrically connected to at least one first pixel circuit and at least one signal output terminal of the demultiplexer, and the first sub-pixels electrically connected to a same first data line being the first sub-pixels with a same color;

a plurality of second pixel units, located in the second display area, each second pixel unit comprising a plurality of second sub-pixels with at least three colors;

a plurality of second pixel circuits, each of the second sub-pixels being electrically connected to one of the second pixel circuits; and a plurality of second data lines extending in the second display area along the column direction and being distributed at intervals along the row direction, and each of the second data lines being electrically connected to at least one second pixel circuit and at least one signal output terminal of the demultiplexer;

wherein the first sub-pixels with a same color in the first pixel units are electrically connected to the signal output terminals with a same charging mode in the demultiplexers, wherein the plurality of second pixel units are distributed in an array in the second display area, and each of the second pixel units comprises a second sub-pixel with a first color, a second sub-pixel with a second color and a second sub-pixel with a third color; and the second pixel units in a same column are corresponding to the second pixel circuits in three columns, the second pixel circuits in three columns comprise a first column of second pixel circuits, a second column of second pixel circuits and a third column of second pixel circuits; wherein the first column of second pixel circuits and the third column of second pixel circuits are electrically connected to the second sub-pixel with the first color and the second sub-pixel with the third color, the second sub-pixels electrically connected to any two adjacent second pixel circuits in the first column of second pixel circuits have different colors, the second sub-pixels electrically connected to any two adjacent second pixel circuits in the third column of second pixel circuits have different colors, the second sub-pixels electrically connected to two second pixel circuits in a same row and respectively in the first column of second pixel circuits and the third column of second pixel circuits have different colors, and the second column of second pixel circuits are electrically connected to the second sub-pixels with the second color.

2. The display panel of claim 1, wherein:

each of the first sub-pixels is electrically connected to one of the first pixel circuits.

3. The display panel of claim 2, wherein the plurality of first pixel units are distributed in an array in the first display area, and the first pixel circuits corresponding to the first sub-pixels with a same color in a same column of the first pixel units are located in a same column.

4. The display panel of claim 2, wherein each of the first pixel units comprises a first sub-pixel with a first color, a first sub-pixel with a second color and a first sub-pixel with a third color;

each of the first data lines comprises a first sub-data line, a second sub-data line and a third sub-data line;

wherein the first sub-data line is electrically connected to the first sub-pixel with the first color, the second sub-data line is electrically connected to the first sub-pixel with the second color, and the third sub-data line is electrically connected to the first sub-pixel with the third color;

the first pixel units in a same column are corresponding to the first pixel circuits in three columns, the first pixel circuits in three columns comprises a first column of first pixel circuits, a second column of first pixel circuits and a third column of first pixel circuits, and in the first pixel units in a same column, the first pixel circuits corresponding to the first sub-pixels with the second color belongs to the first column of first pixel circuits, and each of the second column of first pixel circuits and the third column of first pixel circuits comprises the first pixel circuit corresponding to the first sub-pixel with the first color and the first pixel circuit corresponding to the first sub-pixel with the third color; and the first sub-data line and the third sub-data line corresponding to the first pixel units in a same column are interleaved with each other.

5. The display panel of claim 1, wherein each of the second data lines comprises a fourth sub-data line, a fifth sub-data line and a sixth sub-data line; and the fourth sub-data line is electrically connected to the first column of second pixel circuits, the fifth sub-data line is electrically connected to the second column of second pixel circuits, and the sixth sub-data line is electrically connected to the third column of second pixel circuits.

6. The display panel of claim 5, wherein each of the first pixel units comprises a first sub-pixel with a first color, a first sub-pixel with a second color and a first sub-pixel with a third color;

each of the first data lines comprises a first sub-data line, a second sub-data line and a third sub-data line;

wherein the first sub-data line is electrically connected to the first sub-pixel with the first color, the second sub-data line is electrically connected to the first sub-pixel with the second color, and the third sub-data line is electrically connected to the first sub-pixel with the third color; and each of the first sub-data line, the second sub-data line and the third sub-data line is electrically connected to a corresponding signal output terminal of the demultiplexer through any one of the fourth sub-data line, the fifth sub-data line and the sixth sub-data line in a matching mode.

7. The display panel of claim 6, wherein each of the demultiplexers comprises a first signal output terminal and a second signal output terminal with different charging modes, the first sub-data line and the third sub-data line are electrically connected to the first signal output terminal, and the second sub-data line is electrically connected to the second signal output terminal.

8. The display panel of claim 7, wherein each of the demultiplexers comprises a first transistor and a second transistor, a gate of the first transistor is electrically connected to a first control signal terminal, a gate of the second transistor is electrically connected to a second control signal terminal, a first electrode of the first transistor is the first signal output terminal, a first electrode of the second transistor is the second signal output terminal, and a second electrode of the first transistor and a second electrode of the second transistor are electrically connected to a fan-out line.

9. The display panel of claim 6, wherein each of the first sub-pixel with the first color and the second sub-pixel with the first color is a red sub-pixel, each of the first sub-pixel with the second color and the second sub-pixel with the second color is a green sub-pixel, and each of the first sub-pixel with the third color and the second sub-pixel with the third color is a blue sub-pixel.

10. The display panel of claim 1, wherein each of the demultiplexers comprises a first signal output terminal and a second signal output terminal, the first signal output terminal is controlled by a first control signal and is configured to output a signal when the first control signal is a low-level signal; and the second signal output terminal is controlled by a second control signal and is configured to output a signal when the second control signal is a low-level signal.

11. The display panel of claim 10, wherein a low level of the first control signal does not overlap with a low level of a scan signal, a signal output by the first signal output terminal is firstly stored on a signal line and then input to a corresponding first sub-pixel, and a charging mode of the first signal output terminal is wire charging; and a low level of the second control signal overlaps with the low level of the scan signal, a signal output by the second signal output terminal is directly input to a corresponding first sub-pixel, and a charging mode of the second signal output terminal is direct charging.

12. A display apparatus, comprising the display panel of claim 1.

13. A display panel comprising a display area and a non-display area surrounding the display area, the display area comprising a first display area and a second display area, and a light transmittance of the first display area being greater than a light transmittance of the second display area;

the display panel comprising:

a plurality of first pixel units, located in the first display area, each first pixel unit comprising a plurality of first sub-pixels with at least three colors;

a plurality of demultiplexers, located in the non-display area, each demultiplexer comprising at least two signal output terminals with different charging modes, a plurality of first pixel circuits, and a plurality of first data lines extending in the first display area along a column direction and being distributed at intervals along a row direction, each of the first data lines being electrically connected to at least one first pixel circuit and at least one signal output terminal of the demultiplexer, and the first sub-pixels electrically connected to a same first data line being the first sub-pixels with a same color; wherein each of the first pixel units comprises a first sub-pixel with a first color, a first sub-pixel with a second color and a first sub-pixel with a third color;

each of the first data lines comprises a first sub-data line, a second sub-data line and a third sub-data line;

wherein the first sub-data line is electrically connected to the first sub-pixel with the first color, the second sub-data line is electrically connected to the first sub-pixel with the second color, and the third sub-data line is electrically connected to the first sub-pixel with the third color;

the first pixel units in a same column are corresponding to the first pixel circuits in three columns, the first pixel circuits in three columns comprises a first column of first pixel circuits, a second column of first pixel circuits and a third column of first pixel circuits, and in the first pixel units in a same column, the first pixel circuits corresponding to the first sub-pixels with the second color belongs to the first column of first pixel circuits, and each of the second column of first pixel circuits and the third column of first pixel circuits comprises the first pixel circuit corresponding to the first sub-pixel with the first color and the first pixel circuit corresponding to the first sub-pixel with the third color; and wherein the first sub-pixels with a same color in the first pixel units are electrically connected to the signal output terminals with a same charging mode in the demultiplexers.

* * * * *